US009550289B2

(12) United States Patent
Parks

(10) Patent No.: US 9,550,289 B2
(45) Date of Patent: Jan. 24, 2017

(54) HAND-HELD POWER TOOL WITH TORQUE LIMITING UNIT

(71) Applicant: Black & Decker Inc., Newark, DE (US)

(72) Inventor: James R. Parks, White Hall, MD (US)

(73) Assignee: Black & Decker Inc., New Britain, CT (US)

( * ) Notice: Subject to any disclaimer, the term of this patent is extended or adjusted under 35 U.S.C. 154(b) by 893 days.

(21) Appl. No.: 13/763,959

(22) Filed: Feb. 11, 2013

(65) Prior Publication Data

US 2014/0174775 A1 Jun. 26, 2014

Related U.S. Application Data

(60) Provisional application No. 61/739,767, filed on Dec. 20, 2012.

(51) Int. Cl.

| | |
|---|---|
| ***B25F 5/00*** | (2006.01) |
| ***B25B 21/00*** | (2006.01) |
| ***B25B 23/14*** | (2006.01) |

(52) U.S. Cl.

CPC ..... *B25F 5/001* (2013.01); *B25B 21/00* (2013.01); *B25B 23/141* (2013.01)

(58) Field of Classification Search

CPC ..... B25F 5/001; B25B 21/008; B25B 23/14; B25B 23/142; B25B 23/1422

USPC ..... 173/47

See application file for complete search history.

(56) References Cited

U.S. PATENT DOCUMENTS

| | | | | |
|---|---|---|---|---|
| 1,922,645 | A | 2/1927 | Tower | |
| 2,501,648 | A | 2/1945 | Ogden | |
| 2,778,246 | A | 1/1957 | Thornton | |
| 4,678,452 | A * | 7/1987 | Nelson | F16D 7/044 464/38 |
| 5,190,499 | A | 3/1993 | Morl et al. | |
| 5,735,183 | A | 4/1998 | Sasaki et al. | |
| 5,897,454 | A | 4/1999 | Cannaliato | |
| 6,832,533 | B1 | 12/2004 | Huang | |
| 7,360,607 | B2 * | 4/2008 | Aeberhard | B25B 23/141 173/176 |
| 7,455,123 | B2 | 11/2008 | Aeberhard | |
| 7,766,751 | B2 | 8/2010 | Christensen et al. | |
| 7,806,200 | B2 * | 10/2010 | Spielmann | B25B 23/141 173/104 |

(Continued)

FOREIGN PATENT DOCUMENTS

| | | |
|---|---|---|
| DE | 102004058807 A1 | 6/2006 |
| DE | 102004058808 A1 | 6/2006 |

(Continued)

OTHER PUBLICATIONS

Johannes Pothmann, European Search Report, Mar. 27, 2014, The Hague.

(Continued)

*Primary Examiner* — Gloria R Weeks

(74) *Attorney, Agent, or Firm* — Adan Ayala

(57) ABSTRACT

A hand-held power tool has a torque-limiting unit with which a maximum torque transferred from a motor output shaft to a tool driver is adjustable by an operator. The torque-limiting unit has a spring system with spring elements having substantially similar characteristics (such as length, compression forces, etc.) and yet generating different spring forces.

13 Claims, 2 Drawing Sheets

(56) References Cited

U.S. PATENT DOCUMENTS

| | | | | |
|---|---|---|---|---|
| 8,371,193 | B2 * | 2/2013 | Huang | B25B 23/1427 81/467 |
| 8,528,658 | B2 * | 9/2013 | Roehm | B23B 31/1207 173/176 |
| 9,168,651 | B2 * | 10/2015 | Hecht | B25F 5/001 |
| 2002/0130007 | A1 * | 9/2002 | Nakamura | B25F 5/001 192/38 |
| 2012/0175142 | A1 | 7/2012 | Van Der Linde et al. | |
| 2013/0269461 | A1 * | 10/2013 | Hecht | B25D 11/106 74/335 |
| 2014/0144661 | A1 * | 5/2014 | Roehm | B25B 23/141 173/178 |

FOREIGN PATENT DOCUMENTS

| | | | |
|---|---|---|---|
| DE | 102010042981 | A1 | 5/2012 |
| DE | 102010063953 | A1 | 6/2012 |
| EP | 1448343 | B1 | 7/2005 |
| EP | 1824643 | A1 | 8/2007 |
| EP | 1935569 | A1 | 6/2008 |
| EP | 2008746 | A2 | 12/2008 |
| EP | 1824643 | B1 | 7/2012 |
| GB | 2421550 | B | 11/2007 |

OTHER PUBLICATIONS

Annex to the European Search Report on European Patent Application No. EP 13197877.

* cited by examiner

HAND-HELD POWER TOOL WITH TORQUE LIMITING UNIT

CROSS-REFERENCE TO RELATED APPLICATIONS

The present application derives priority under 35 USC §119(e) from U.S. Provisional Application No. 61/739,767, filed on Dec. 20, 2012, which is hereby incorporated by reference in its entirety.

FIELD OF THE INVENTION

The present invention relates to a power tool and particularly to hand-held power tools with torque limiting units.

BACKGROUND

Hand-held power tools, such as cordless screwdrivers, cordless drills or cordless impact drills have a high amount of drive torque. Limiting this torque is desirable for many applications. Adjustable torque limitation makes it possible, e.g., to screw a number of screws into a work piece with the same level of screw-down torque; a torque-limiting unit disengages as soon as the screws apply a certain level of torque resistance to the motor output shaft. The operator can adjust the torque-limiting unit according to the maximum torque required for the task at hand. A hand-held power tool with torque limitation of the type described above is made known in DE 103 09 057 A1.

Another hand-held power tool with a torque limiting unit is described in U.S. Pat. No. 7,455,123, and is fully incorporated in its entirety by reference. As described therein, the torque limiting unit has springs 26, 28 of different spring characteristics, i.e., using different spring rates, widths, lengths and/or stiffness. Requiring such different springs is costly as it is necessary to maintain a full inventory of different springs. It also makes assembly of the power tool difficult, as the assembler has to ensure each spring has been installed correctly in each place. Therefore, the likelihood of manufacturing defects is increased.

Accordingly, it is an object of the present invention to provide a hand-held power tool with a torque-limiting unit, which is a further improvement of the existing hand-held power tools.

SUMMARY

The present invention is directed to a hand-held power tool with a torque-limiting unit with which a maximum torque transferred from a motor output shaft to a tool driver is adjustable by an operator, the torque-limiting unit including a spring system. The spring system uses a set of similar springs having substantially similar characteristics.

In this manner a non-linear spring characteristic curve of the spring system can be obtained using simple spring elements without requiring different types of spring elements. As a result, a maximum torque can be easily set in a range of small torques very precisely and over a broad torque range. Typically, an adjustable maximum torque is between 1 Nm and 15 Nm, e.g., to quickly drive screws into wood without damaging the screws or the wood.

A particularly comfortable adjustment of the maximum torque can be obtained when the maximum torque can be set very precisely in a range of small torques, e.g., up to 5 Nm. To this end, the spring system can have a spring characteristic curve in this range that is flatter than it is in the range of greater torques, in which the maximum torque can be adjusted less precisely. A different action of the spring elements can be achieved when the spring elements are located such that they are staggered in terms of their direction of motion. When the spring system is actuated, for example, only a few spring elements are actuated at first, followed by all spring elements.

A particularly simple assembly and compact design of the hand-held power tool can be achieved when the spring elements have the same elasticity. By holding the spring elements in different positions, the identical springs would effectively have different spring characteristic curves, e.g, different spring rates or levels of stiffness.

DETAILED DESCRIPTION

Figure 1:
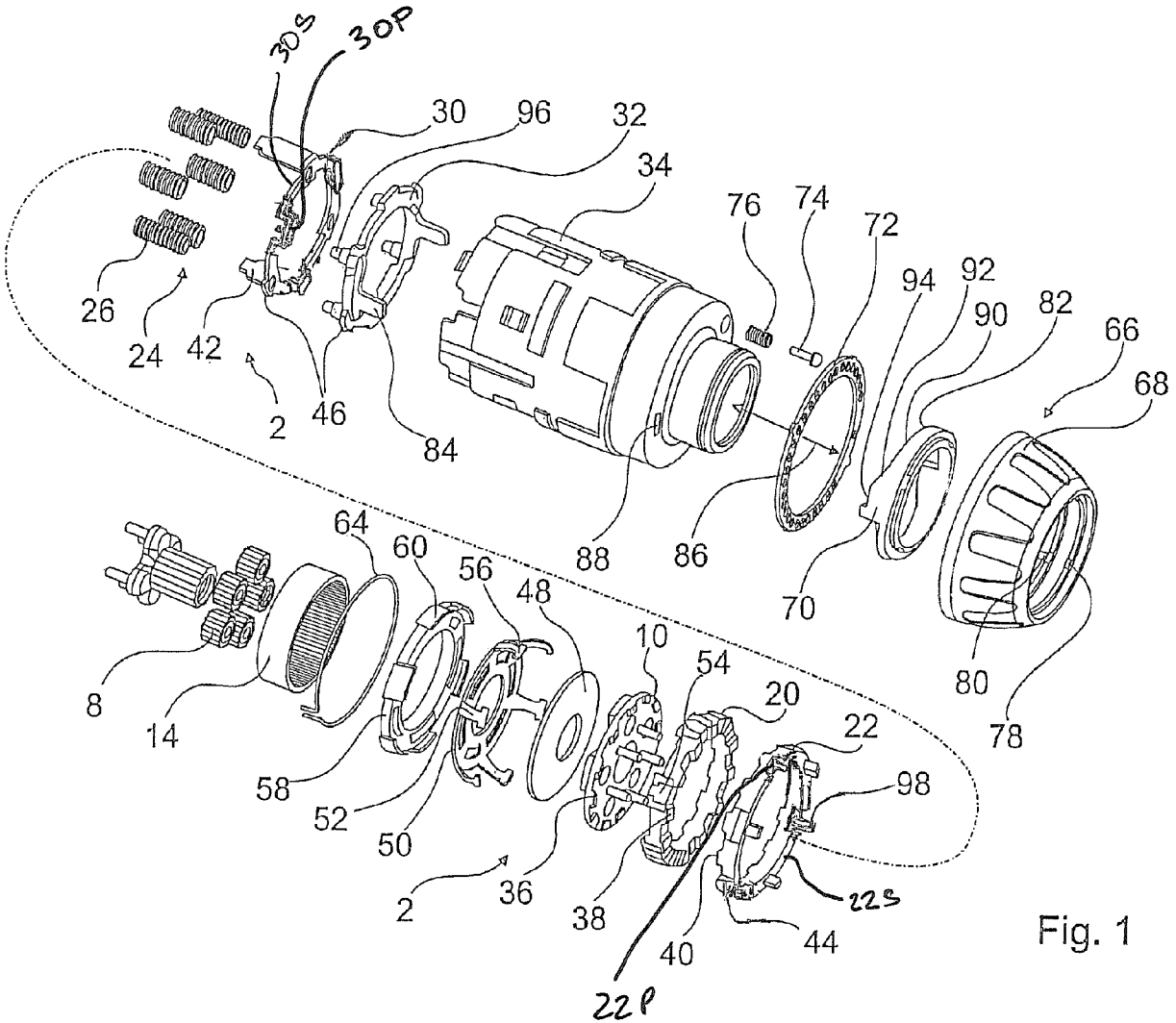
FIG. 1 shows a front part of a cordless screwdriver with a torque-limiting unit and an overload clutch, in an exploded view.
Figure 2:
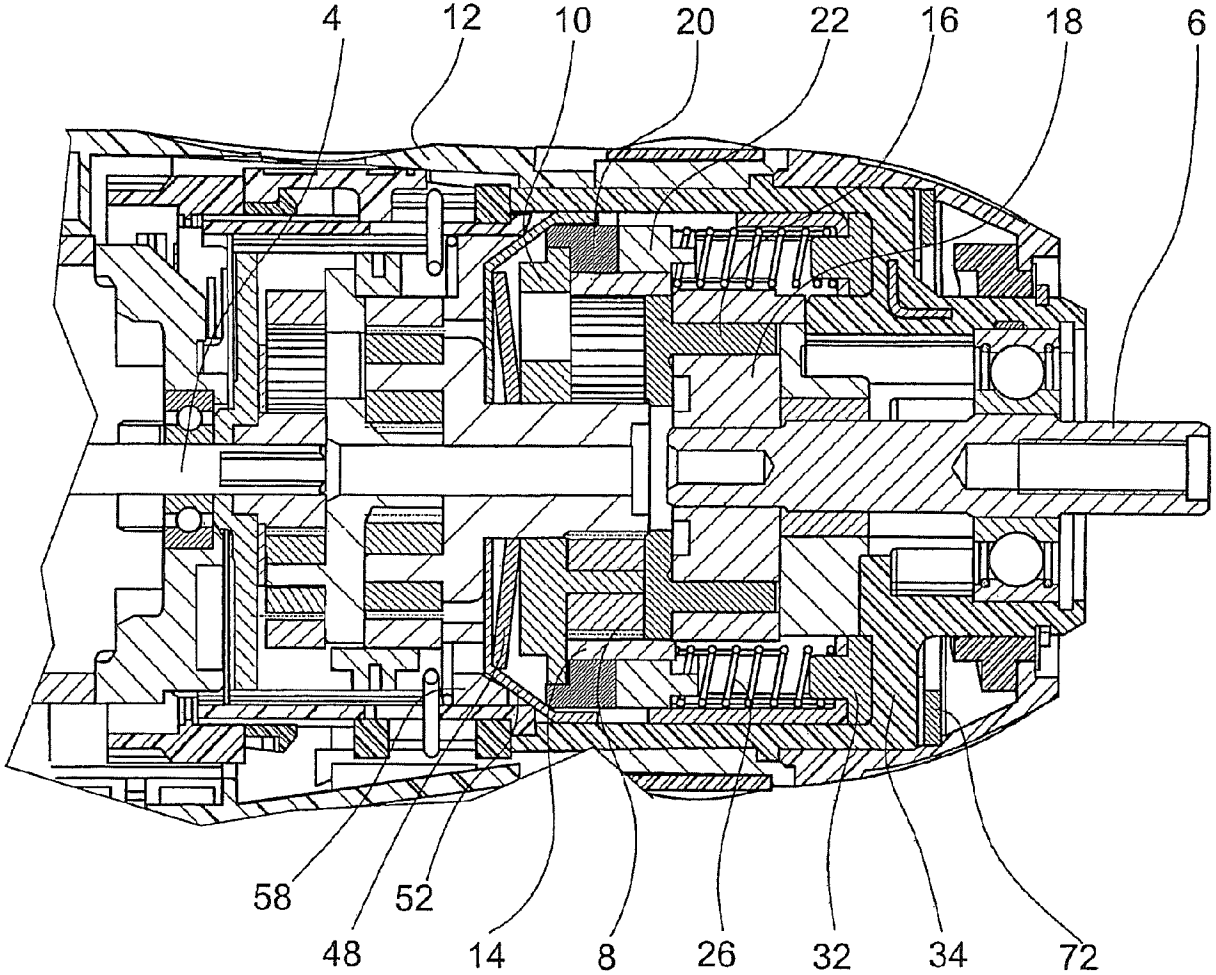
FIG. 2 shows the front part of FIG. 1 in a sectional view.

FIGS. 1 and 2 show a front part of a hand-held power tool designed as a cordless screwdriver, in an exploded view (FIG. 1) and a sectional illustration (FIG. 2).

The hand-held power tool includes a torque-limiting unit 2, a motor output shaft 4, and a tool driver 6. To drive tool driver 6, torque from motor output shaft 4 is transferred to three-stage planetary gearing that includes planet gears 8 that therefore rotate on their axes. Planet gears 8 are supported on a planet carrier 10 that, in the normal working mode, is fixedly connected with a housing 12 of the hand-held power tool. Planet gears 8 drive an internal gear 14, the inner toothing of which encompasses a driving element 16 and drives it. Driving element 16 drives a star wheel 18, and star wheel 16 drives tool driver 6 via a square socket.

In normal operation, planet carrier 10 is non-rotatably connected with a guide sleeve 34 via two locking discs 22, 20, a spring system 24 preferably composed of six spring elements 26 and two thrust members 30, 32, with guide sleeve 34, in turn, being non-rotatably fastened to housing 12 of the hand-held power tool. The non-rotatable connection is created by cams 36 on planet carrier 10 that engage with cams on first locking disc 20, first locking disc 20 with cams 38 being connected with second locking disc 22 via cams 40 on second locking disc 22. Second locking disc 22 is retained by arms 42 of thrust member 30, arms 42 extending between raised areas 44 of second locking disc 22. Both thrust members 30, 32 are retained via projections 46 in the inner grooves of guide sleeve 34.

A disk spring 48 is located behind planet carrier 10 on the transmission side, disk spring 48 being inserted in a holder 50. Holder 50 encompasses disk spring 48 and planet carrier 10 via arms 52, and engages in recesses 54 of first locking disc 20. Arms 52 are held in recesses 54 via wide sections 56, holder 50 being held—via a tension with which disk spring 48 is compressed slightly—against locking disk 20 and clamps planet carrier 10 between disk spring 48 and locking disk 20. A retaining wheel 58 is located behind holder 50; it engages via recesses 60 in inner grooves of guide sleeve 34 and is therefore non-rotatably connected with guide sleeve 34 and a wire ring 64 in guide sleeve 34.

To adjust a maximum torque to be transferred to tool driver 6, the spring pressure of spring system 24 applied to second locking disc 20 can be varied with the aid of adjusting element 66. To this end, adjusting element 66 includes an actuating element 68, a cam ring 70, a locking disk 72, a bolt 74, and a spring 76. A recess 78 and a groove 80 non-rotatably hold cam ring 70 and/or locking disk 72 in actuating element 68. When actuating element 68 is rotated, cam ring 70 also rotates, arms 84 sliding on a cam track 82 of cam ring 70, which causes second thrust member 32 to move in axial direction 86.

Arms 84 extend through recesses 88 in guide sleeve 34 and, loaded by the spring force of coiled springs 24, are pressed against cam track 82. When second thrust member 32 moves in axial direction 86, the spring pressure of spring system 24 with which second locking disc 22 is pressed against first locking disk 20 varies. Locking disk 72, via its holes in which bolt 74 engages, prevents unintentional displacement of actuating element 68 during operation of the hand-held power tool.

Spring system 24 preferably includes six spring elements 26 situated in a spring assembly. Spring elements 26 are preferably designed as compression springs in the form of coiled springs. Spring elements 26 may be positioned in a hexagonal pattern.

As seen in FIG. 1, spring elements 26 may be disposed between locking disk 22 and thrust member 30. Spring elements 26 preferably contact locking disk 22 and thrust member 30. Locking disk 22 may have different surfaces 22S, 22P that contact spring elements 26. Preferably, the different surfaces 22S, 22P will be at different levels for the reasons specified below. For example, surface 22P is below surface 22S as seen in FIG. 1.

Similarly, thrust member 30 may have different surfaces 30S, 30P that contact spring elements 26. Preferably, the different surfaces 30S, 30P will be at different levels for the reasons specified below. For example, surface 30S is below surface 30P as seen in FIG. 1.

By varying the distances between surfaces 22S, 22P and 30S, 30P, the length of each spring element 26 can be selected to differ from the length of another spring element 26, without requiring spring elements with differing characteristics. For example, a spring disposed between surfaces 22P and 30S will have an effective length that is shorter than a spring disposed between surfaces 22P and 30P. Preferably, three spring elements 26 will be disposed between surfaces 22P and 30S, while three other spring elements 26 could be disposed between surfaces 22S and 30P in an alternating arrangement around the circumference of locking ring 22. Persons skilled in the art will recognize that the distance between surfaces 22P and 30P and/or the distance between surfaces 22S and 30P can be selected so that it is substantially equal to the distance between surfaces 22S and 30S.

Such arrangement will effectively create some springs that are shorter and stronger spring action—and others that are longer with weaker spring action, even if all the spring elements 26 the same at-rest characteristics. As a result of this stable arrangement, a single-staged progression of the maximum torque can be attained with uniform displacement of cam ring 70.

When the smallest possible maximum torque of 1 Nm is set via cam ring 70, the longer spring elements 26 are held between locking disk 22 and thrust member 30 with slight preload. When cam ring 70 is rotated toward a larger maximum torque, spring elements 26 are initially compressed, whereas shorter spring elements 26 are still located between locking disk 22 and thrust member 30 with a slight amount of play. Starting at a maximum torque of 4 Nm, when cam ring 70 is rotated further, the shorter spring elements 26 are also compressed, so that the maximum torque now increases more rapidly when cam ring 70 is rotated in a uniform manner, and in fact, up to a value of 15 Nm.

During normal operation of the hand-held power tool, in which a torque applied to tool driver 6 is below the set maximum torque, planet carrier 10 is stationary relative to housing 12. If the torque applied to tool driver 6 reaches the maximum torque level that was set, second locking disc 22 is deflected against spring system 24 by beveled flanks of cams 38, 40, and first locking disc 20 can rotate against second locking disc 22 along with planet carrier 10. Internal gear 14 is stationary, and the transfer of torque from motor output shaft 4 to tool driver 6 is interrupted above the maximum torque.

To bridge torque-limiting unit 2, cam ring 70 includes—in addition to a uniformly increasing first segment 90 inside radial cam 82 to realize a drilling mode—a second, more steeply rising segment 92 and a third, flat segment 94 that brings about no change in the spring pressure of spring system 24 when cam ring 70 is rotated. The maximum torque of 1 Nm to 15 Nm is adjusted by moving arms 84 over first segment 90.

When the bridging-over setting is set, arms 84 rest on third segment 94 and are deflected away to a maximum extent in the direction of motor output shaft 4 of the hand-held power tool. Spring elements 26 are compressed together so far that pins 96, 98 holding spring elements 26 each other. As a result, locking disk 22 is retained between locking disk 20 and thrust member 32 in axial direction 86 such that it cannot be deflected. First locking disk 20 is now unable to slide over second locking disk 22. In addition, arms 42 extend between recesses 54 of locking disc 20, by way of which locking disk 20 is non-rotatably connected with guide sleeve 34.

In this position, a level of torque that could damage the hand-held power tool and that is dangerous to the operator could be transferred to tool driver 6 by torque-limiting unit 2. To prevent this much torque from being transferred, an overload clutch that interrupts the flux of force to tool driver 6 when an overload torque is exceeded is located on planet carrier 10. If a torque level is transferred to tool holder 6 that reaches the level of overload torque specified by the spring force of disk spring 48 in the drilling position, plant carrier 10 is deflected via beveled flanks of cams 36 and the cams on locking disk 20 in the direction toward disk spring 48, and disk spring 48 is compressed further against its preload. Planet carrier 10 can now rotate against locking disk 20, by way of which the flux of force from motor output shaft 4 to tool driver 6 between planet carrier 10 and locking disk 20 is interrupted.

It will be understood that each of the elements described above, or two or more together, may also find a useful application in other types of constructions differing from the types described above.

While the invention has been illustrated and described as embodied in hand-held power tool with a torque-limiting unit, it is not intended to be limited to the details shown, since various modifications and structural changes may be made without departing in any way from the spirit of the present invention.

Without further analysis, the foregoing will reveal fully reveal the gist of the present invention that others can, by applying current knowledge, readily adapt it for various applications without omitting features that, from the standpoint of prior art, fairly constitute essential characteristics of the generic or specific aspects of the invention.

What is claimed is:

1. A hand-held power tool, comprising:

a motor output shaft;

a tool driver;

a first and a second locking disc;

a thrust member; and a torque-limiting unit with which a maximum torque transferred from said motor output shaft to said tool driver is adjustable by an operator, said torque-limiting unit including a spring system, said spring system including a plurality of spring elements, where first and second spring elements have the same length at rest, the first spring element generating a spring force larger than a spring force generated by the second spring element, wherein said spring system is held by said second locking disc and each spring element of the spring system is held between a pin of the second locking disc and a pin of said thrust member, wherein the first locking disc is connected with the second locking disc via cams, wherein said cams are built on each of said locking discs, wherein if a torque applied to the tool driver reaches a selected maximum torque level, the second locking disc is deflected against the spring system by beveled flanks of said cams, and the first locking disc can rotate against the second locking disc.

2. A hand-held power tool as defined in claim 1, wherein said spring elements of said spring system are compression springs.

3. A hand-held power tool as defined in claim 1, wherein said plurality of spring elements further includes third, fourth, fifth and sixth spring elements.

4. A hand-held power tool as defined in claim 1, wherein one of said spring elements of said spring system is configured as a spring element of an overload clutch that interrupts a flux of force between said motor output shaft and said tool driver when a transferred torque exceeds a preset overload torque.

5. A hand-held power tool as defined in claim 1, and further comprising an adjusting element for adjusting the maximum torque transferable from said motor output shaft to said tool driver, said adjusting element having a radial cam with a uniformly increasing curved path.

6. A hand-held power tool as defined in claim 1, wherein each of said spring elements of said spring system is held by a pin of said second locking disc.

7. A hand-held power tool as defined in claim 6, wherein said radial cam includes a first segment for adjusting a maximum torque and a second segment with a control effect that is different from a control effect of said first segment, for adjusting a drilling mode without adjustable torque limitation.

8. A hand-held power tool as defined in claim 6, wherein the pins of said second locking disc are spaced apart in a circumferential direction of said second locking disc.

9. A hand-held power tool as defined in claim 1, wherein each of said spring elements of said spring system is slipped on a pin of said second locking disc.

10. The hand-held power tool as recited in claim 1, wherein pins of the thrust member are spaced apart in a circumferential direction on the thrust member.

11. The hand-held power tool as recited in claim 1, wherein the second locking disc and the thrust member have a ring-like shape.

12. The hand-held power tool as recited in claim 1, wherein the first locking disc interacts with the second locking disc to form the torque-limiting unit.

13. The hand-held power tool as recited in claim 1, wherein the first locking disc interacts with a planet carrier to form an overload clutch.

* * * * *